US005425462A

United States Patent [19]

Sciranka

[11] Patent Number: 5,425,462

[45] Date of Patent: Jun. 20, 1995

[54] HINGE PIN CLOTHES HANGER

[76] Inventor: John A. Sciranka, 21405 Maple St., Wildomar, Calif. 92695

[21] Appl. No.: 92,931

[22] Filed: Jul. 19, 1993

Related U.S. Application Data

[63] Continuation-in-part of Ser. No. 949,013, Sep. 21, 1992, abandoned.

[51] Int. Cl.[6] ..... A47F 7/00

[52] U.S. Cl. ..... 211/96; 248/213.1; 248/290

[58] Field of Search ..... 211/96, 86; 248/213.1, 248/290

[56] References Cited

U.S. PATENT DOCUMENTS

| | | | |
|---|---|---|---|
| 914,697 | 3/1909 | Bryant | 248/213.1 X |
| 1,208,986 | 12/1916 | Krodel | 248/213.1 X |
| 2,049,903 | 8/1936 | Flinn | 248/213.1 |
| 2,509,502 | 5/1950 | Hunt | 248/290 |
| 2,684,225 | 7/1954 | Johnson | 248/282 |
| 2,895,698 | 7/1959 | Palmer | 211/96 X |
| 3,044,630 | 7/1962 | Szabo | 248/290 |
| 3,825,127 | 7/1974 | Morrison et al. | 211/96 |

*Primary Examiner*—Alvin C. Chin-Shue
*Assistant Examiner*—Sarah L. Purol

[57] ABSTRACT

The principal effect and objective of the hinge pin clothes hanger is to furnish a quality product made to last, that replaces the hinge pin of any door hinge with a hinge pin clothes hanger that, when properly installed, does not effect the operation of the door or the hinge into which it is being used. The hinge pin clothes hanger is a non-destructive support on which to hang clothes, towels or anything similar, on any door hinge, in any room in which it would be useful. It is easily installed or removed without any damage to the door or hinge. You simply remove the existing hinge pin and install the hinge pin clothes hanger in its place, or simply remove the hinge pin clothes hanger to restore the hinge to its original condition with the original hinge pin. It's that simple. Furthermore, when in use the hinge pin clothes hanger will provide a substantial means of support which will give the consumer years of reliable service and will blend into the decor of the room into which it is being used.

3 Claims, 2 Drawing Sheets

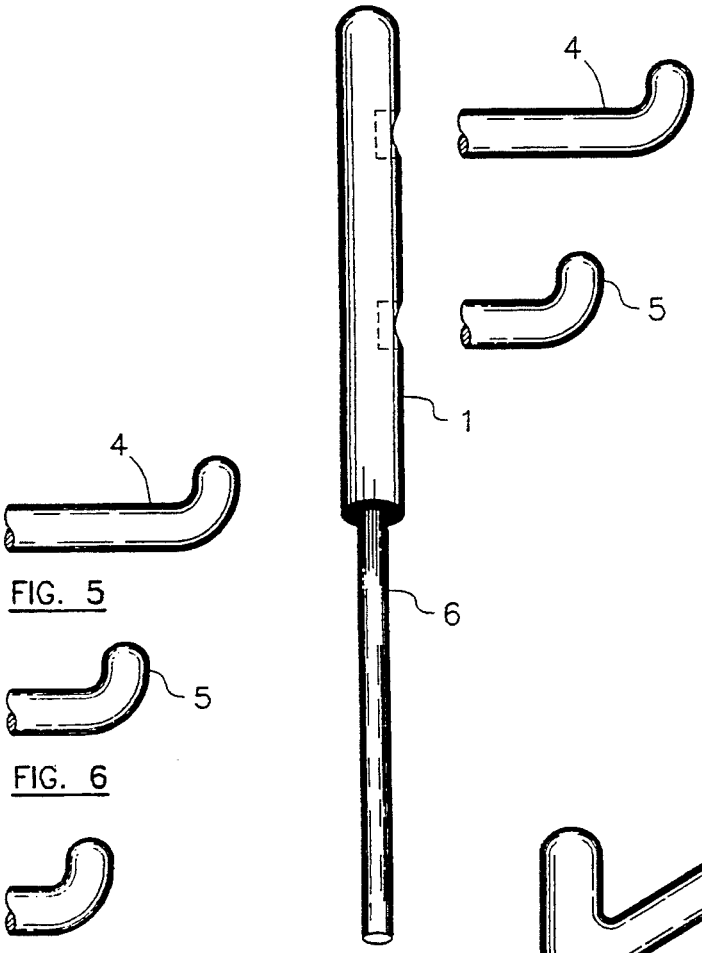
FIG. 4
FIG. 5
FIG. 6
FIG. 7
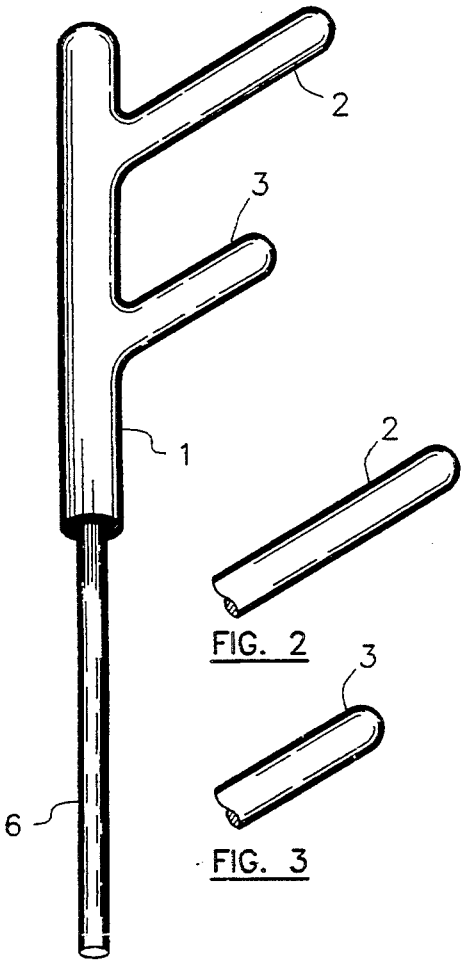
FIG. 1
FIG. 2
FIG. 3

HINGE PIN CLOTHES HANGER

This is a continuation-in-part of Ser. No. 07/949,013, filed Sep. 21, 1992, now abandoned.

BACKGROUND OF INVENTION

1. Field of Invention

This invention relates in general to household item and in particular to the hanging of clothing onto a non-destructive device on the hinge pin of a door hinge.

2. Prior Art

I have been a renter for over 20 years now and I have been faced with security deposit deductions because of objects left behind after relocating to another residence. One item in particular, the hangers, (screws, nails, hooks, etc.) that are fastened onto doors on which to hang clothing.

As a renter you either leave the hangers on the doors when you move, or remove them and be faced with repairing the holes in the door. I feel it's cheaper to leave the hangers on the door but your next place of residence might need them and you have to purchase them again. There are other instances in which you can't or don't want to attach hangers on the doors because of door construction—hollow door, uniqueness of door—nicely finished wood—both of which could result in expensive repairs.

You do not necessarily need to be a renter to be faced with these last two circumstances. A home owner might not want to attach a hanger to a nicely finished door. This is one of the advantages of this present invention. It is a non-destructive support on which to hange clothes. You simply remove the existing hinge pin and install the hinge pin clothes hanger in its place. It's that simple.

All of the examples of the prior art related to door or hinge attached hangers are set forth in the patents described below: U.S. Pat. Nos.

Des. 170,725 Stahl: This is an ornamental design for a hinge.

Des. 197,702 Loeb: This is an ornamental design for a cabinet hinge.

2,509,502 Hunt: This hanger is not a unitary part of the hinge pin. It could interfere with the full operation of the hinge.

2,684,225 Johnson: This support is much too complicated for a simple means of hanging clothes.

2,895,698 Palmer: This clothes hanger is much too large to use as a simple alternate support on which to hang clothes.

2,896,791 Raber: These portable supports seem to be permanently attached to the hinge and are too complicated for a simple non-destructive attachment to the hinge.

3,044,630 Szabo: This hinge pin hook is not a unitary part of the hinge pin and is made to fit between the head of the hinge pin and the top of the hinge. This shortens the hinge pin and makes for a sloppy fit when weight is hung on the hooks. It is a filmsy arrangement.

3,145,849 Hanson: This hanger bracket is much too long for a clothes hook. It appears to be made for clothes hung on hangers.

3,175,696 Melbourne: The hanger structure also seems to be set up for clothes hung on hangers and is much too large for a simple clothes support.

3,200,435 Hemmeter et al: This hanger is designed to have shoes and clothes on hanger's hung onto it.

3,294,248 Olson: This clothes hanger is similar to Hanson, Hemmeter et al, described above. Again, it appears to be designed for clothes hung on hangers.

3,825,127 Morrison et al: The hinge hanger is made for clothes hung on hangers. This is similar in design to Olson, Hemmeter et al, Hanson referenced above. Norwegian patent:

57,263: This device and its construction do not appear sturdy.

Whatever the precise merits, features, and advantages of the above cited references, none of them achieves, or fulfills the purposes of the hinge pin clothes hanger, this present invention. The principal effect and objective of this present invention is to furnish a quality product made to last. Another accomplishment of this present invention is to provide a sturdy support which replaces the hinge pin of any door hinge. Additionally this present invention quickly attaches a non-destructive support on which to hang clothes, towels, or anything similar, on any door, in any room in which it would be useful. Furthermore, this present invention is easily installed or removed without any damage to the door or hinge.

SUMMARY OF THE INVENTION

The principal effect and objective of this present invention is to furnish a quality product made to last, that replaces the hinge pin of any door hinge with a hinge pin clothes hanger that, when properly installed, does not effect the operation of the door or hinge into which it is being used. The hangers are an integral part of the body of the hinge pin clothes hanger. The head of the hinge pin is extended above the top of the hinge to carry the hangers. This appliance is of one piece construction. Additionally this present invention is a non-destructive device which can be easily removed to restore the hinge to its original condition with the original hinge pin. Furthermore when in use this present invention will provide years of reliable service and will blend into the decor of the room into which it is being used.

BRIEF DESCRIPTION OF THE DRAWINGS

FIG. 1. This is a complete two hanger version of the hinge pin clothes hanger. It is shown in a side view.

FIG. 2. This is a detail of the longer of the two hangers. It shows the overall length of the part. It is shown in a side view.

FIG. 3. This is a detail of the shorter of the two hangers. It shows the overall length of the part. It is shown in a side view.

FIG. 4. This is a complete variation of the hinge pin clothes hanger. It is shown in a side view.

FIG. 5. This is a detail of a variation of the longer of two hangers. It shows the overall length of the part. It is shown in a side view.

FIG. 6. This is a detail of a variation of the shorter of two hangers. It shows the overall length of the part. It is shown in a side view.

FIG. 7. This is a detail of the radius of a variation of the hanger as it should be made onto the end of parts "4" and "5". It is shown in a side view.

DETAILED DESCRIPTION OF THE INVENTION

Refer now to FIG. 1 which is an overall drawing of a preferred embodiment of the invention. The number of hangers and shape of support are preferred because of their simplicity of appearance and symmetry of design. It is suggested that, because of maintenance free characteristics, the entire invention—parts "1", "2", "3" and "6"—be constructed of stainless steel and be T.I.G. welded for a clean appearance and for sturdy heavy duty construction.

Parts "1" and "6" are of one piece construction, or are attached to each other or made in a way that they become a unitary, inseparable part of each other. It is essential that part "6", the hinge pin part, be machined or made to duplicate the diameter and length of the hinge pin it is to replace, so the hinge pin clothes hanger does not effect the operation of the door or the hinge into which it is positioned. It is important that part "1", the body of the hinge pin clothes hanger, is to be similar to the diameter of the hinge pin head, as illustrated in FIG. 1. It is suggested that the length of part "1" be approximately four inches.

Again, it is suggested that part "1" has two holes made into its body to accept parts "2" and "3" respectively. These holes are made into part "1" to put the hangers on approximately a 45 degree angle as seen in FIG. 1. It is further suggested that these holes be approximately ¼" deep. Furthermore, these holes made into part "1" should be larger than the diameter of parts "2" and "3" to allow for a snug fit. It is suggested that the centerline of the hole for part "2" is 1¼" from the top of part "1", and the centerline of the hole for part "3" is 2 9/16"from the top of part "1". It is shown in FIGS. 2 and 3 that parts "2" and "3" are ⅜" in diameter. It is suggested that a round end be shaped onto the end of part "2" and "3" to make the end of the hanger.

After the hangers are fitted into their respective holes or the hangers are attached or made to the body, part "1", in a way that they become a unitary part of each other, with hanger ends facing up, as shown in FIG. 1, the lower hanger is always shorter in length than the hanger above it, parts "1", "2", and "3" now become the clothes hanger part of the hinge pin clothes hanger, as shown in FIG. 1. The overall length of part "2" is noted in FIG. 2. The overall length of part "3" is noted in FIG. 3.

When all of the above mentioned components are machined, cut, fitted and T.I.G. welded together, the outcome will be the hinge pin clothes hanger which the hinge pin part, body, and the hangers are attached to each other or made in a way that they become a singular, unitary, inseparable part of each other, comprised of one or more hangers, hanger ends facing up, and provide a substantial means of support which will give the consumer years of reliable service.

Figure 8:
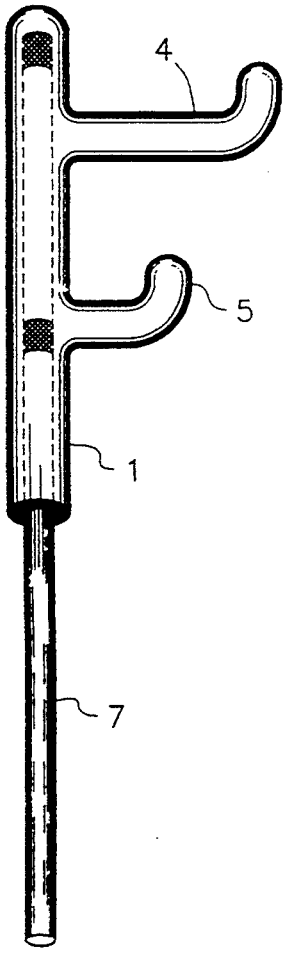
FIG. 8. This is a complete two hanger version showing the position of the metal pin. It is shown in a side view.
Figure 9:
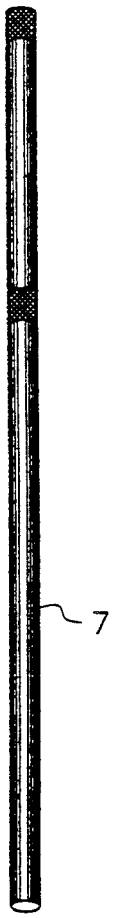
FIG. 9. This is a detail of the metal pin. It shows the knurling in two places.

Another suggestion for construction of the hinge pin clothes hanger is by the injection molding process. The body and hangers, parts '1', '4' and '5' are injection molded around the metal pin, part '7'. This metal pin, part '7' as shown in FIG. 9, is knurled in two places to allow the material, plastic or nylon for example, a rough surface on which to grip as it cools and shrinks around the pin. This allows the material to permanently and solidly bond to the pin. This metal pin, part '7', extends into the body and becomes unitary with the body and hangers, parts '1', '4' and '5' as shown in FIG. 8. Parts '1', '4' and '5', the body and hangers become a singular, unitary, inseparable part of each other through the injection molding process. The injection molding process eliminates the necessity for the holes to be formed into the body for the positioning of the hangers. The machining of the tooling or mold allows the body and hanger, parts '1', '4' and '5', to be molded as one piece around the pin.

Yet another suggestion for making the hinge pin clothes hanger is to cast or pour a molten material, such as brass, bronze, aluminum or even stainless steel for example, into a mold. When the metal has hardened and taken out of the mold it is a completed hinge pin clothes hanger. The pin, part '6', the body, part '1' and the hooks, parts '4' and '5' can be cast at the same time into this mold. An alternative method would be to insert the pin, part '7', into the casting and pour the molten material around the pin. Again when the metal has hardened and taken out of the mold it is a completed hinge pin clothes hanger.

ALTERNATIVES

Refer now to FIG. 4 which is an overall drawing of a variation of the preferred embodiment of the invention. It is also suggested that parts "1", "4", "5", "6" be constructed of stainless steel and be T.I.G. welded for a clean appearance and for sturdy heavy duty construction. It is also important that part "1", the body of the hinge pin clothes hanger, is made to be similar to the diameter of the hinge pin head, as illustrated in FIG. 4.

Again, it is suggested that part "1" has two holes made into its body to accept parts "4" and "5" respectively. These holes are made into part "1" on the vertical plane. It is further suggested that these holes be approximately ¼" deep. Furthermore, these holes made into part "1" should be larger than the diameter of parts "4" and "5" to allow for a snug fit. It is suggested that the centerline of the hole for part "4" be 13/16" from the top of part "1", and the centerline of the hole for part "5" be 2 3/16" from the top of part "1". It is shown in FIGS. 5 and 6 that parts "4" and "5" are ⅜" in diameter, and a hook be made onto the end of parts "4" and "5" to make the end of the hanger. A detail of the hook for parts "4" and "5" is shown in FIG. 7.

After the hangers are fitted into their respective holes or the hangers are attached or made to the body, part "1", in a way that they become a unitary part of each other, with hanger ends facing up, as shown in FIG. 4, the lower hanger always shorter in length than the hanger above it, parts "1", "4" and "5" now become the clothes hanger part of the hinge pin clothes hanger, as shown in FIG. 4. The overall length of part "4" is noted in FIG. 5. The overall length of part "5" is noted in FIG. 6.

As disclosed in the Detailed Description of the invention, stainless steel is the preferred material because of its maintenance free characteristics. Other metals or materials may be selected for their ability to be easily plated or colored, to enhance the decor of a room. An example would be a brass plated hinge pin clothes hanger to match the rest of the hinge or other trim in a bathroom. Another example would be to anodize the hinge pin clothes hanger to match the trim in a room.

The number, shape and length of the hangers, FIGS. 1, 2, and 3 as presented in the Detailed Description of the invention is the preferred embodiment of the invention because of its simplicity and appearance. A one hanger hinge pin clothes hanger, or a three or more hanger "Hinge Pin Clothes Hanger", may be desired, the shape of the hangers can also be altered, as shown in FIGS. 4, 5 and 6.

As revealed in the Detailed Description of the invention and in FIG. 1, the individual diameter of parts "1" and "6" will vary to duplicate and replace the hinge pin of different size hinges. It is important that the diameter of part "1" be similar to the diameter of the hinge pin head it is to replace and it is essential that the diameter and length of part "6" duplicate the diameter and length of the same hinge pin As cited above, it is preferred that the parts of the hinge pin clothes hanger be machined, cut, fitted and T.I.G. welded together. There are other methods of achieving the same end result. These practices, processes, or materials do not limit the way this present invention should or could be made.

The foregoing descriptions of the two embodiments of the invention have been presented for the purpose of illustration and description. It is not intended to be exhaustive or to limit the invention to the precise form disclosed. Many modifications and variations are possible in light of the above teaching. It is intended that the scope of the invention be limited not by this Detailed Description, but rather by the Claims appended hereto.

What is claimed is:

1. A device intended for replacing the hinge pin of a door hinge, said device consisting of a hinge pin part, a body, and at least two hangers, said hinge pin part and said body being unitary, said body extending above said hinge pin part and said door hinge, said body having a larger cross section than said hinge pin part, said body having at least two holes formed therein for receipt of said at least two hangers, wherein said hangers are permanently fit into said holes.

2. A device intended for replacing the hinge pin of a door hinge, said device consisting of a hinge pin part, a body and at least one hanger, said body and said at least one hanger being unitary, said body extending above said door hinge, said hinge pin part extends into said body, said body having larger cross section than said hinge pin part, wherein said body is solidly and permanently bonded around said hinge pin part.

3. A device intended for replacing the hinge pin of a door hinge, said device consisting of a hinge pin part, a body, and at least one hanger, said hinge pin part, said body, said hangers being unitary, said body extending above said door hinge, said body having larger cross section than said hinge pin part.

* * * * *